US005380020A

United States Patent [19]

Arney et al.

[11] Patent Number: 5,380,020

[45] Date of Patent: Jan. 10, 1995

[54] IN-LINE SKATE

[75] Inventors: Michel D. Arney, Needham; Carl L. Madore, Brighton, both of Mass.; Andrzej M. Malewicz, Minneapolis, Minn.

[73] Assignee: Rollerblade, Inc., Minneapolis, Minn.

[21] Appl. No.: 10,604

[22] Filed: Jan. 28, 1993

[51] Int. Cl.[6] ..... A63C 17/04

[52] U.S. Cl. ..... 280/11.22; 36/115

[58] Field of Search ..... 280/11.19, 11.22, 11.23, 280/11.27, 11.3; 36/87, 89, 91, 115, 121; D21/226; D2/276

[56] References Cited

U.S. PATENT DOCUMENTS

D. 275,813 10/1984 Sartor .
D. 302,838 8/1989 Wendt .
4,126,323 11/1978 Scherz .
5,048,848 9/1991 Olson .
5,052,703 10/1991 Bertrand .
5,092,614 3/1992 Malewicz ..... 280/11.22
5,171,033 12/1992 Olson ..... 280/11.22
5,193,827 3/1993 Olson ..... 280/11.22
5,207,454 5/1993 Blankenburg et al. ..... 280/11.22
5,236,224 8/1993 Anderson et al. ..... 280/11.22

OTHER PUBLICATIONS

Rollerblade Ad, Sprint 1989, No. 2.

*Primary Examiner*—Richard M. Camby
*Attorney, Agent, or Firm*—Merchant, Gould, Smith, Edell, Welter & Schmidt

[57] ABSTRACT

An in-line skate includes a boot lower and a frame intricately formed through monocoque construction. The boot lower and frame are formed from a material having a predetermined stiffness. A boot upper is secured to the boot lower. The boot upper includes a material selected to have a stiffness less than the stiffness of said boot lower.

5 Claims, 6 Drawing Sheets

IN-LINE SKATE

BACKGROUND OF THE INVENTION

1. Field of the Invention

This invention pertains to in-line skates. More particularly, this invention pertains to a novel construction of such a skate.

2. Description of the Prior Art

The sport of in-line skating has become increasingly popular in recent years. An example of an in-line skate is shown in U.S. Pat. No. 5,171,033.

Most prior designs of in-line skates included a boot and a frame. The frame carried the wheels of the skate. The frame would be separately fabricated from the boot and fastened to the boot through any suitable means.

Construction of such in-line skates has evolved and includes so-called monocoque construction where the frame and the boot shell are intricately molded.

In the design of an in-line skate, there are competing interests for flexibility and stiffness of materials. It is desirable that the boot and skate frame be stiff in order to transmit forces from the user to the wheels during the skating action. However, flexibility is desired for comfort.

It is an object of the present invention to provide an in-line skate which incorporates both flexibility and stiffness.

SUMMARY OF THE INVENTION

According to a preferred embodiment to the present invention, an in-line skate is provided having a boot lower intricately formed with a skate frame and formed of a stiff material. A boot upper is separately formed from a flexible material and secured to the boot lower.

DESCRIPTION OF THE PREFERRED EMBODIMENT

Figure 1:
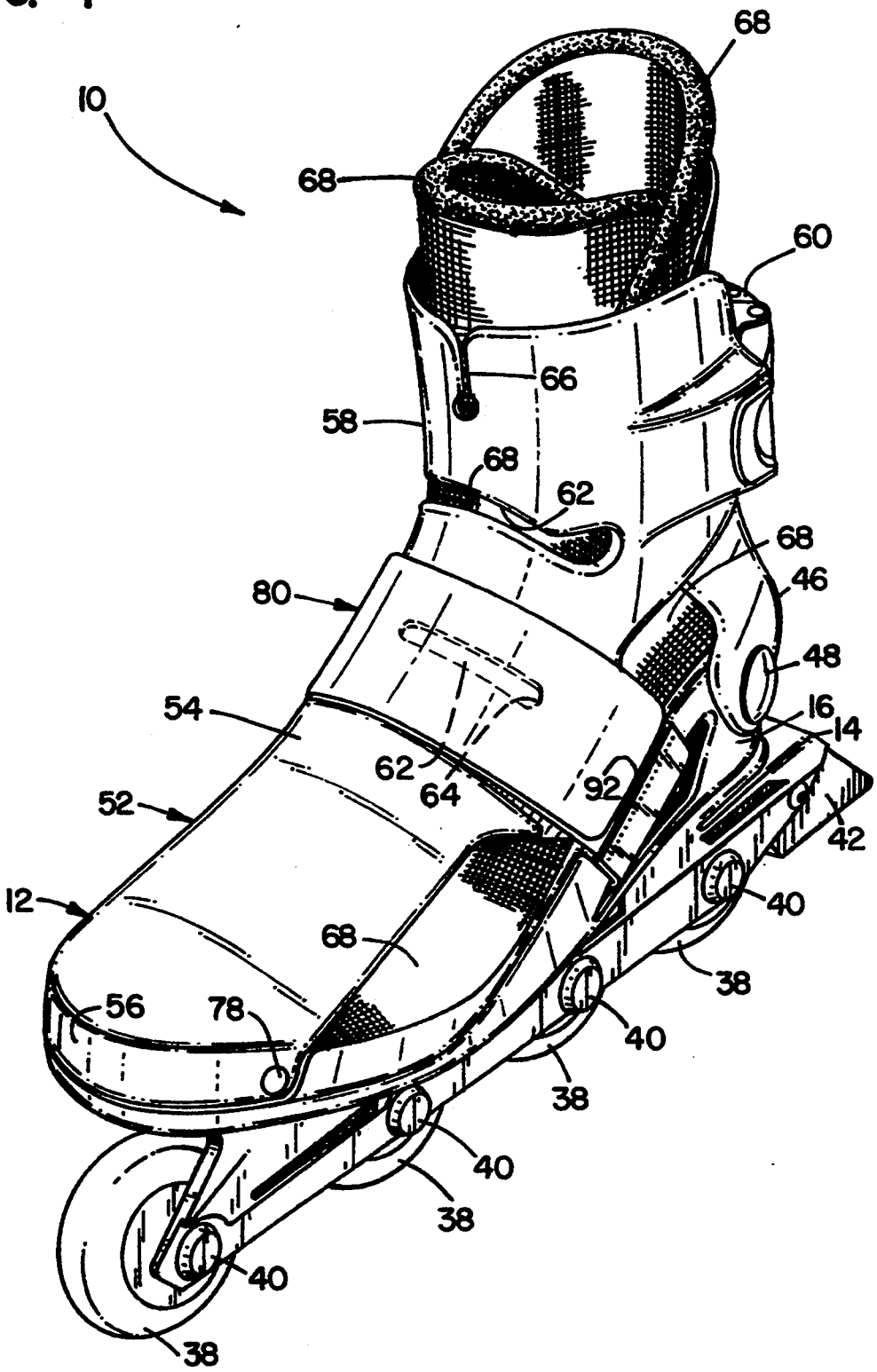
FIG. 1 is a top, front and left side perspective view of an in-line skate according to the present invention.
Figure 3:
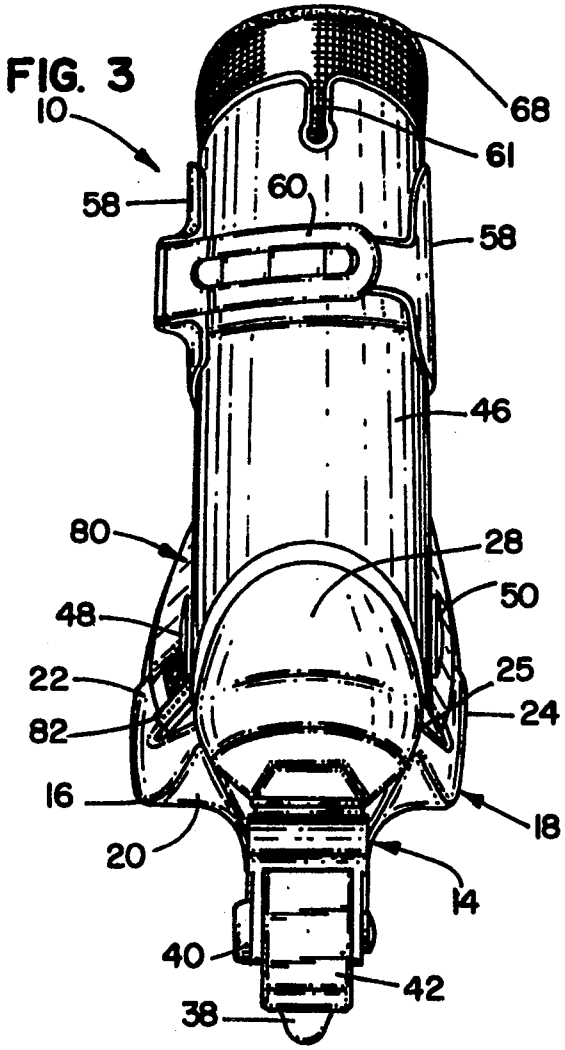
FIG. 3 is a rear elevation view of the skate of FIG. 1.
Figure 2:
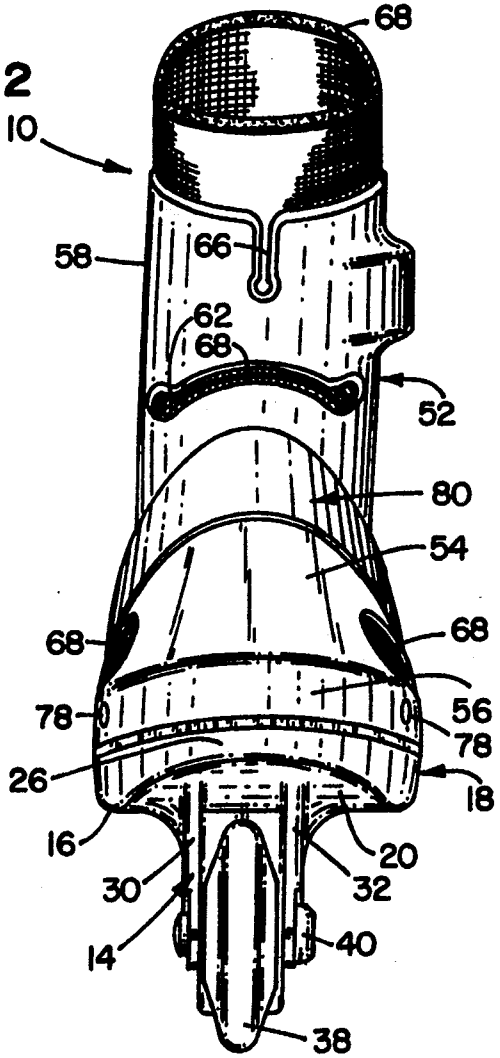
FIG. 2 is a front elevation view of an in-line skate according to the present invention.

Referring now to the several drawing figures in which identical elements are numbered identically throughout, a description of the preferred embodiment will now be provided.

In the figures, an in-line skate according to the present invention is shown generally at 10. The skate 10 includes a boot portion 12 and a frame portion 14. In the preferred embodiment, the boot portion 12 includes a boot lower 16 which is intricately formed with the frame 14 through monocoque construction to form a shell 18 which includes both the boot lower 16 and the frame 14.

Preferably, the shell 18 is formed of a stiff material such as unreinforced nylon.

Figure 4:
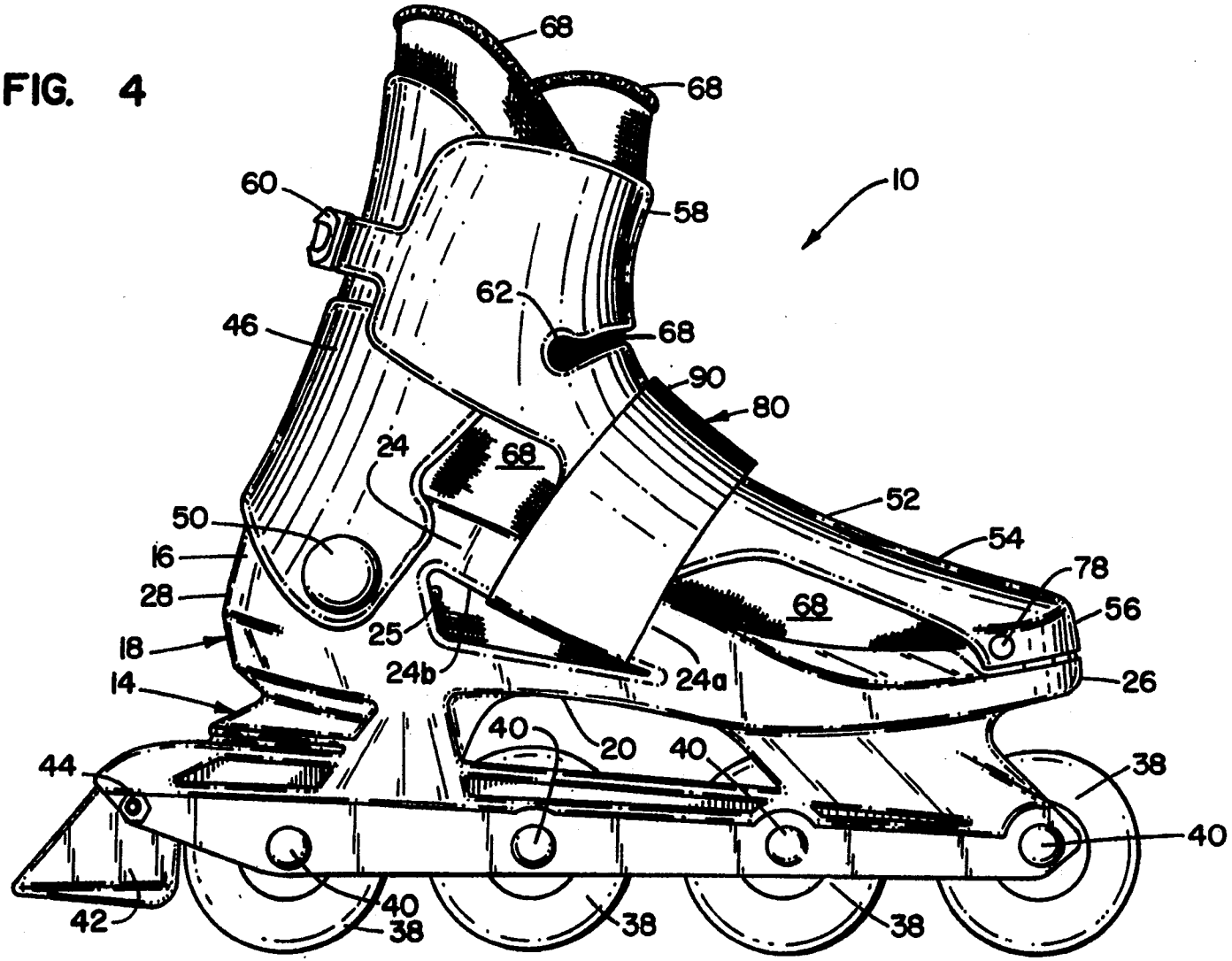
FIG. 4 is a right side elevation view of the skate to FIG. 1.
Figure 5:
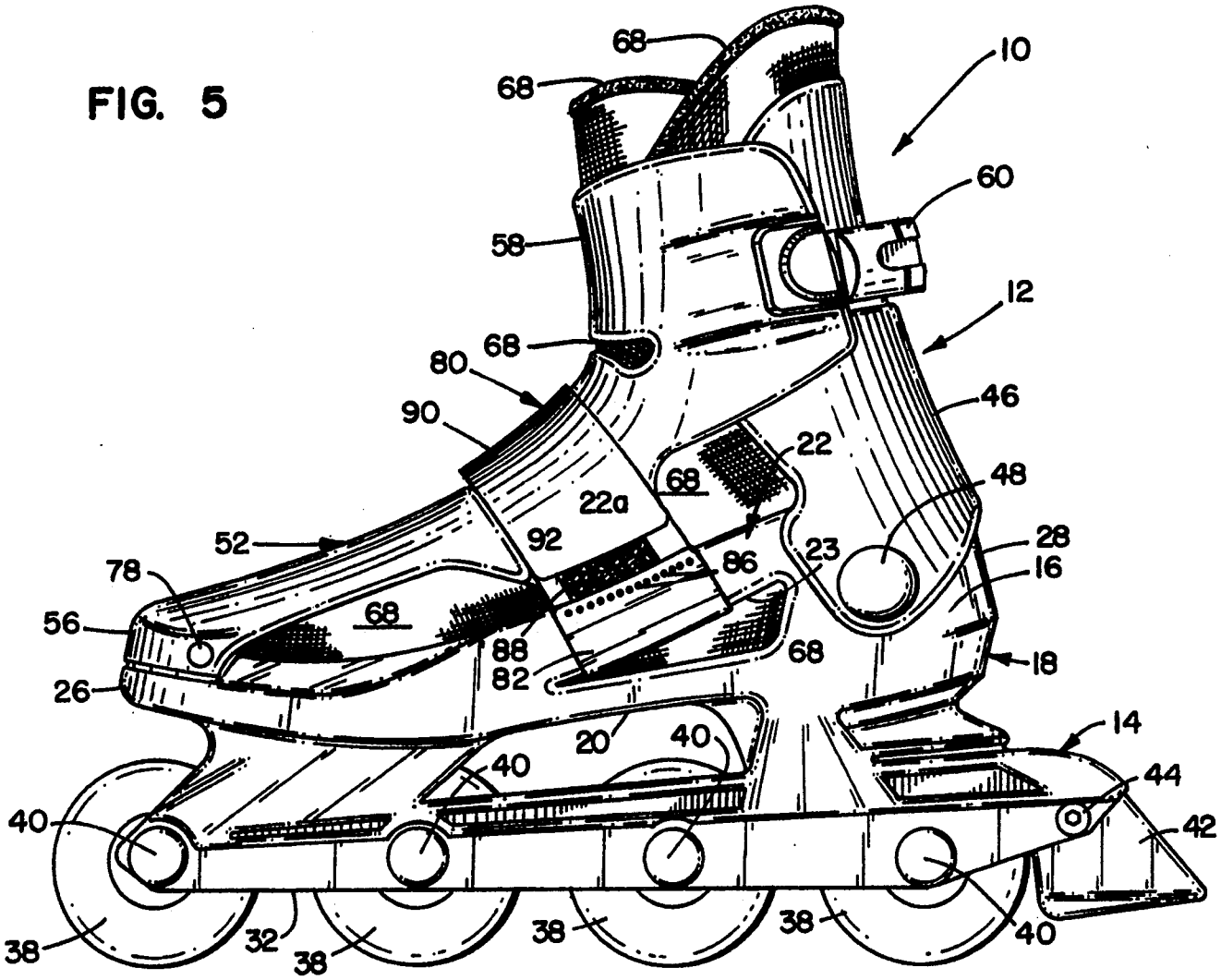
FIG. 5 is a left side elevation view of the skate to FIG. 1.
Figure 6:
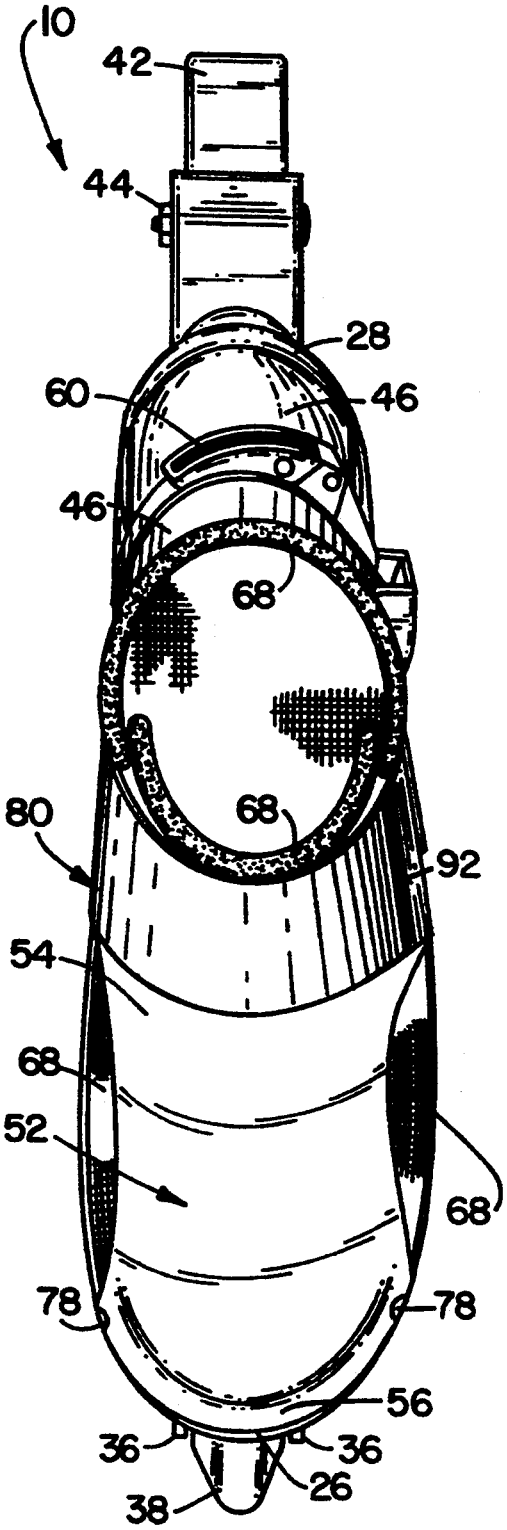
FIG. 6 is a top plan view of the skate to FIG. 1.

As shown in the figures (e.g., FIGS. 4 and 5), the boot portion 12 includes a sole 20, sidewalls 22,24, a toe portion 26 and a heel portion 28.

The sidewalls 22,24 slope upwardly from the toe to the heel 28 such that the heel 28 is sized to cover the heel of a user. Holes 23,25 are formed in sidewalls 22,24 at about the location of the arch of the user.

Figure 7:
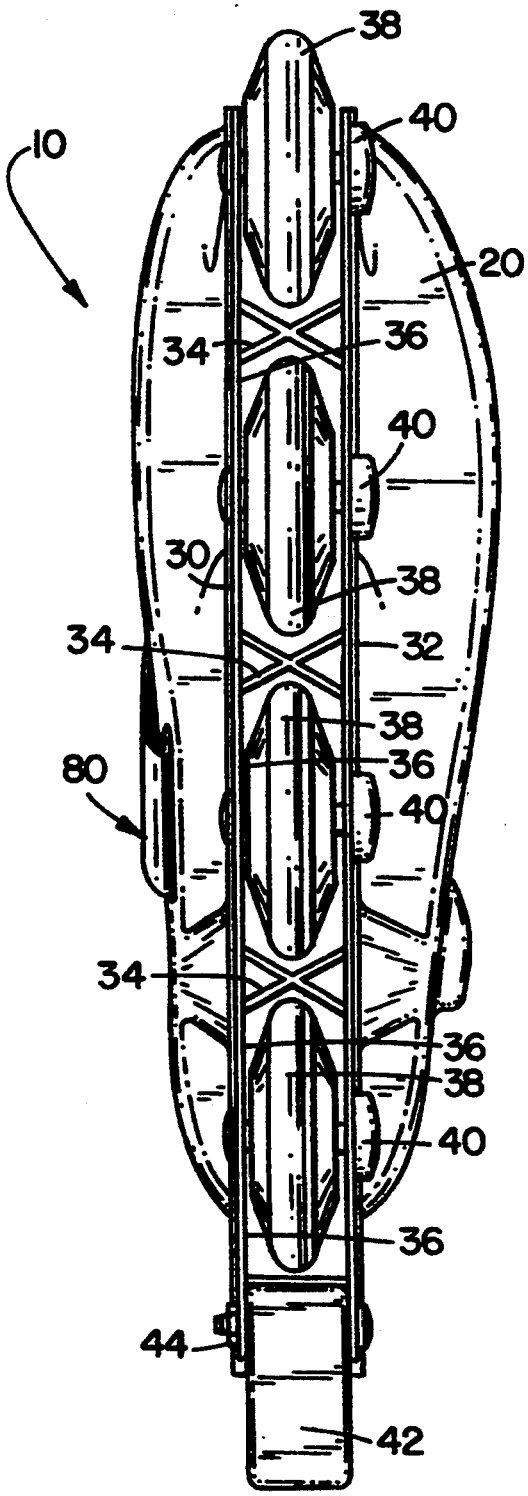
FIG. 7 is a bottom plan view of the skate of FIG. 1.

The frame 14 includes sidewalls 30,32 which are parallel and spaced apart and run substantially the length of the skate 10. The sidewalls 30,32 are braced by cross-bracing 34. The cross-bracing 34 in sidewalls 30,32 define wheel receiving pockets 36 (FIG. 7) into which wheels 38 are positioned. The wheels 38 are rotatably secured to sidewalls 30,32 by wheel shaft assemblies 40. An elastomeric brake 42 is secured to the rear of the frame 14 by a nut and bolt assembly 44.

A cuff 46 (preferably formed of molded polyethylene) is secured to the sidewalls 22,24 by rivets 48,50. The cuff 46 surrounds the upper portion of heel 28 and extends upwardly to provide support on the back of the leg of the user as is conventional.

The boot portion 12 further includes a boot upper 52. The upper 52 is preferably formed of molded polyurethane which is less rigid than the unreinforced nylon of shell 18.

The upper 52 includes a section 54 which is sized to cover the instep of the user. Extending downwardly from the front of the section 52 is an upper toe section 56. Extending upwardly from the rear section of 54 is an upwardly extending section 58 which surrounds the lower shin of the user and wraps partially around the cuff 46. A quick release buckle 60 is provided for securing the section 58 snugly around the lower shin of the user. Quick release buckles such as buckle 60 are well known in the art with no further description being required to facilitate an understanding by those skilled in the art.

Transverse slots 62,64 are provided in the upper 52 to enhance flexibility. Further, a vertical slot 66 is provided in the section 58 for enhanced flexibility. A conventional liner 68 is received within the boot portion 12.

Figure 8:
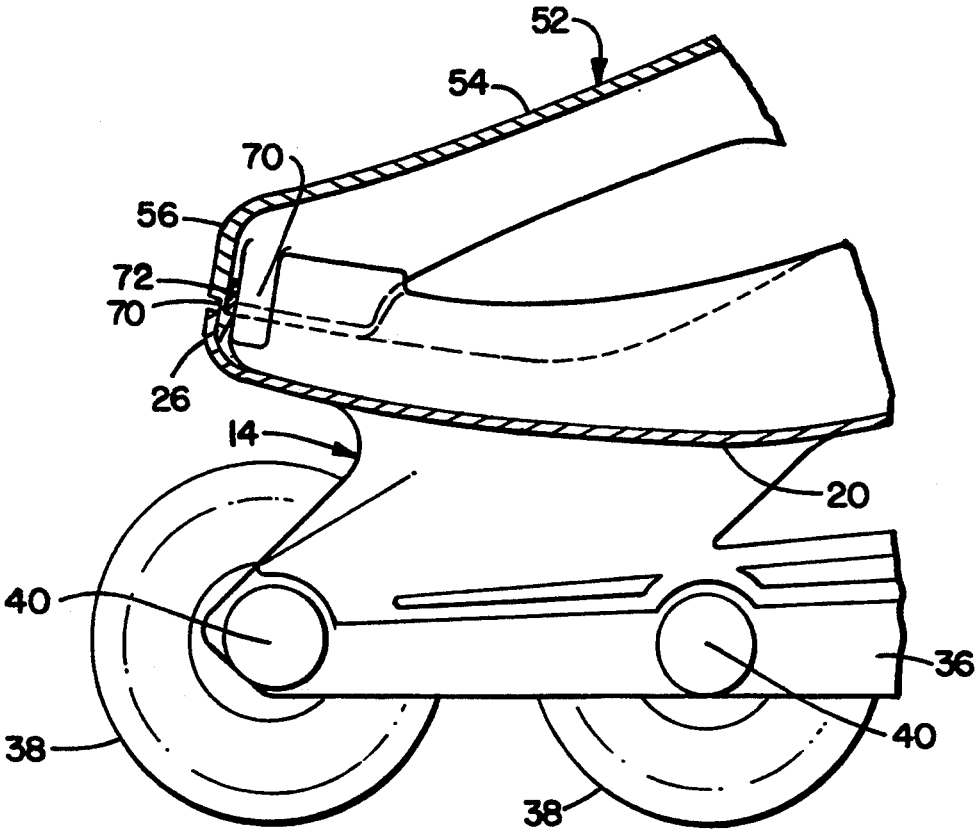
FIG. 8 is a side elevation view, taken partially in section illustrating attachment of an upper of the skate to a lower of the skate boot.

The upper 54 has its toe portion 56 secured to the toe portion 26 of boot lower 16. FIG. 8 illustrates the attachment as including a snap clip 70 formed on upper toe portion 56 which is received and captured beneath a ridge 72 formed on the toe portion 26 of the boot lower 16. Also, to prevent outward flexing of the toe portion 56, rivets 78 are provided on opposite sides of the toe portion 56 to rivet the toe portion 56 to the toe portion 26 of the boot lower 16.

A strap 80 is provided for securing the instep of the boot upper 52 to the boot lower 16. The strap is preferably formed of PVC vinyl. Best shown with reference to FIGS. 9 and 10, the sidewalls 22,24 includes upper rails **22*a*,24*a* which form the upper perimeters of holes 23,25, respectively. A retaining clip 82 is provided with a groove 84 sized to be received on rail 22*a***.

A first end 84 of the PVC vinyl strap 80 is secured to the clip 82 through any suitable means such as stitching 86. A lower fold 88 of strap 80 extends from end 84 and is passed through a slot 86 formed in rail **24*a* and passed around a lower end 24*b* of rail 24*a* to form an upper fold 90 which terminates at a free end 92**.

Upper fold 90 is provided with the loop portion 93 of a hook and loop fastener system (such as Velcro, or the like). The bottom fold 88 is provided with the hook portion 94 opposing the loop portion 93. As a result, the user can quickly fasten and unfasten strap 80 to facilitate placement or removal of the foot within the boot 12. The strap is then tightened to the user's satisfaction.

Figure 9:
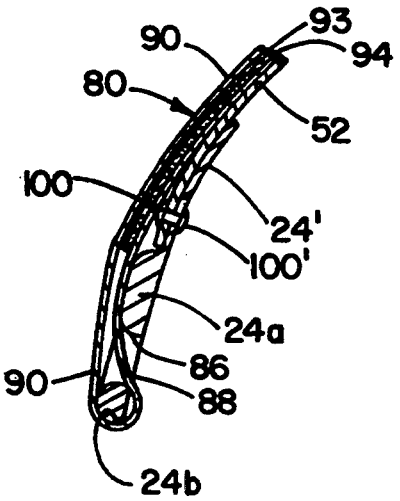
FIG. 9 is a sectional view of an attachment of a strap to the skate on a right side of the skate.
Figure 10:
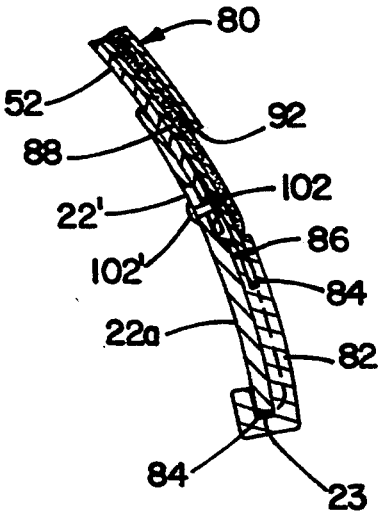
FIG. 10 is a sectional view of an attachment of the strap of the skate on a left side of the skate.

The rails 22*a*, 24*a* of sidewalls 22, 24 are each provided with vertical slots 22', 24' (see FIGS. 9 and 10). Rivets 100, 102 having heads 100', 102' with diameters greater than the width of slots 22', 24' are secured to opposite sides of upper 52. The rivets 100, 102 pass through slots 22', 24' with heads 100', 102' retaining the rivets 100, 102 within the slots 22', 24'. This assembly permits instep portion 54 to rise or lower relative to lower body portion 16 by reason of rivets 100, 102 having limited relative vertical movement within slots 22', 24' when strap 80 is unfastened.

The reader will note that with the benefits of the foregoing described structure, a monocoque construction skate may be fabricated having all the benefits of monocoque construction including the use of a stiff material to precisely transmit forces from the user's foot to the skate wheels. For flexibility and comfort, a separate upper is provided together with a quick release strap and a quick release clip 60. Furthermore, the strap 80 is flexible to further enhance the comfort of the skate 10.

From the foregoing detailed description of the present invention, a description of the preferred embodiment has been provided. However, modifications and equivalents, other disclosed concepts, such as those which readily occur to one skilled in the art, are intended to be included within the scope of the claims.

What is claimed is:

1. A boot for an in-line skate, said boot comprising:

a molded boot lower and a molded boot upper;

said boot lower including a sole portion and a heel portion, said sole portion sized to receive the bottom of a foot of a user and said heel portion sized to substantially cover and surround a heel of said user said boot lower further including sidewalls extending upwardly from said sole;

a rear cuff secured to said sidewalls adjacent said heel portion and sized to surround a back portion of a leg of said user;

said upper portion including an instep portion and a forward cuff portion with said forward cuff portion sized to partially surround said rear cuff with means for releasably urging said forward and rear cuffs to securely grab a lower leg of said user;

a forward end of said boot upper secured to a toe end of said boot lower; and means for releasably securing said instep portion to said boot lower.

2. A boot according to claim 1 comprising strain relief slots formed in said instep portion.

3. A boot according to claim 1 wherein said means includes a strap having a first end secured to a first one of said sidewalls with said strap passed over said upper and passed through a second of said sidewalls and with said strap folded back onto itself with means for releasably securing said strap in a fixed position.

4. A boot according to claim 1 comprising a frame having a plurality of in-line wheels secured to said frame with said frame secured to said boot lower portion.

5. A boot according to claim 4 wherein said boot lower and said frame are intricately formed through monocoque construction.

* * * * *